US006095863A

United States Patent [19]

Tung

[11] Patent Number: 6,095,863

[45] Date of Patent: Aug. 1, 2000

[54] ELECTRICAL CARD CONNECTOR HAVING A GROUNDING SHIELD

[75] Inventor: Shun-Chi Tung, Tu-Chen, Taiwan

[73] Assignee: Hon Hai Precision Ind. Co., Ltd., Taiepi Hsien, Taiwan

[21] Appl. No.: 09/304,130

[22] Filed: May 3, 1999

[30] Foreign Application Priority Data

Dec. 22, 1998 [TW] Taiwan ..... 87221331

[51] Int. Cl.[7] ..... H01R 13/648

[52] U.S. Cl. ..... 439/607; 439/101

[58] Field of Search ..... 439/101, 607, 439/102, 103, 608, 609, 610, 677, 92

[56] References Cited

U.S. PATENT DOCUMENTS 5,387,114 2/1995 Brunker et al. ..... 439/108

5,674,083 10/1997 Whiteman, Jr. et al. ..... 439/181

5,807,137 9/1998 Janota et al. ..... 439/607

*Primary Examiner*—Lincoln Donovan

*Assistant Examiner*—Chandrika Prasad

*Attorney, Agent, or Firm*—Wei Te Chung

[57] ABSTRACT

An electrical card connector includes a header having a top surface forming a number of insertion slots and protrusions. A grounding shield is attached to the top surface of the header along a given direction, the grounding shield having an attaching portion defining a number of cutouts facing toward the given direction and a plurality of fixing slots therein, the cutout engaging with the protrusions of the header to restrict the shield from moving toward the given direction. A fastener has a pair of inserting portions, each inserting portion forming a flat edge at a side thereof facing the given direction and a tined edge opposite the flat edge for extending through the fixing slot of the shield into the insertion slot of the header to restrict the shield from moving toward a direction opposite to the given direction.

9 Claims, 5 Drawing Sheets

ELECTRICAL CARD CONNECTOR HAVING A GROUNDING SHIELD

BACKGROUND OF THE INVENTION

1. Field of the Invention

The present invention relates to an electrical card connector, and particularly to an electrical card connector having a grounding shield which is easily and securely attached thereto.

2. Description of Prior Art

Some electrical card connectors have grounding shields attached to headers of the electrical card connectors by a fastener 7 as shown in FIG. 1. An inserting portion 71 of the fastener 7 extends through an insertion slot 61 of a grounding shield 6 and is received in a receiving slot 81 of a header 8 thereby attaching the shield 6 to the header 8. A pair of tines 711 formed on both sides of the inserting portion 71 interferentially engage with inner walls of the receiving slot 81 of the header 8. The insertion slot 61 of the shield 6 should be sufficiently dimensioned for facilitating extension of the inserting portion 71 therethrough. After assembly, however, the shield 6 may become easily displaced in relation to the inserting portion 71 of the fastener 7 since the insertion slot 61 has a diameter slightly larger than the distance between two opposite tines 711 of the inserting portion 71. Thus, the grounding shield 6 cannot be securely attached to the header 8.

SUMMARY OF THE INVENTION

Accordingly, an object of the present invention is to provide an electrical card connector having means for securely attaching a grounding shield to the connector.

In a preferred embodiment of the present invention, an electrical card connector comprises a header having a top surface forming a plurality of insertion slots and protrusions thereon. A grounding shield is attached to the top surface of the header along a given direction, the grounding shield having an attaching portion defining a plurality of cutouts facing toward the given direction and a plurality of fixing slots therein, the cutout engaging with the protrusions of the header to restrict the shield from moving toward the given direction. A fastener has a pair of inserting portions, each inserting portion forming a flat edge at a side thereof facing the given direction and a tined edge opposite the flat edge for extending through the fixing slot of the shield into the insertion slot of the header to restrict the shield from moving toward a direction opposite to the given direction.

BRIEF DESCRIPTION OF THE DRAWINGS

Other objects and advantages of the present invention will be understood from the following description of an electrical card connector according to a preferred embodiment of the present invention shown in accompanying drawings, in which.

DETAILED DESCRIPTION OF THE PREFERRED EMBODIMENT

Figure 1:
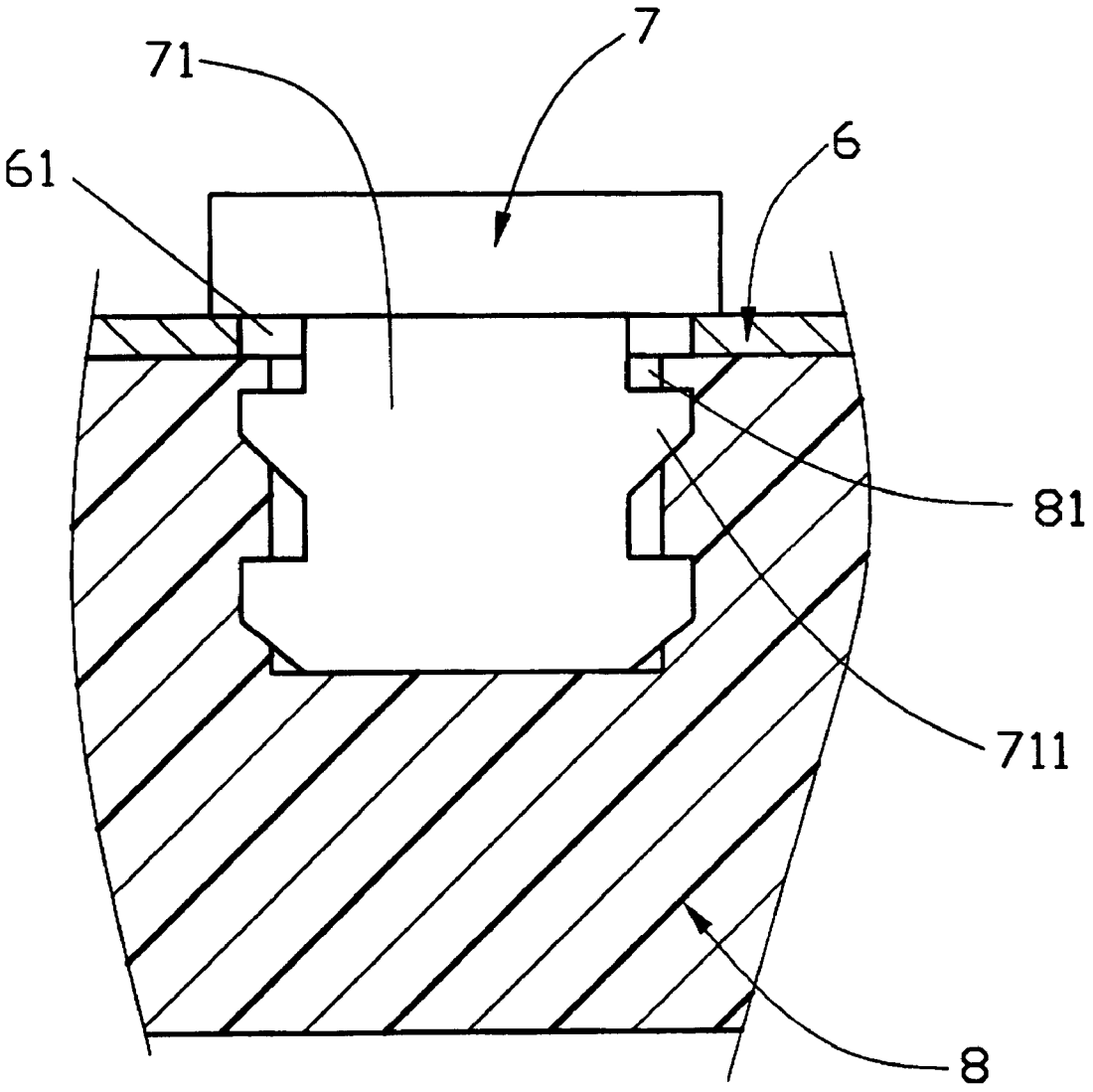
FIG. 1 (PRIOR ART)
FIG. 1 is a partial cross-section view of a conventional connector showing a grounding shield attached to a header by a fastener.
Figure 2:
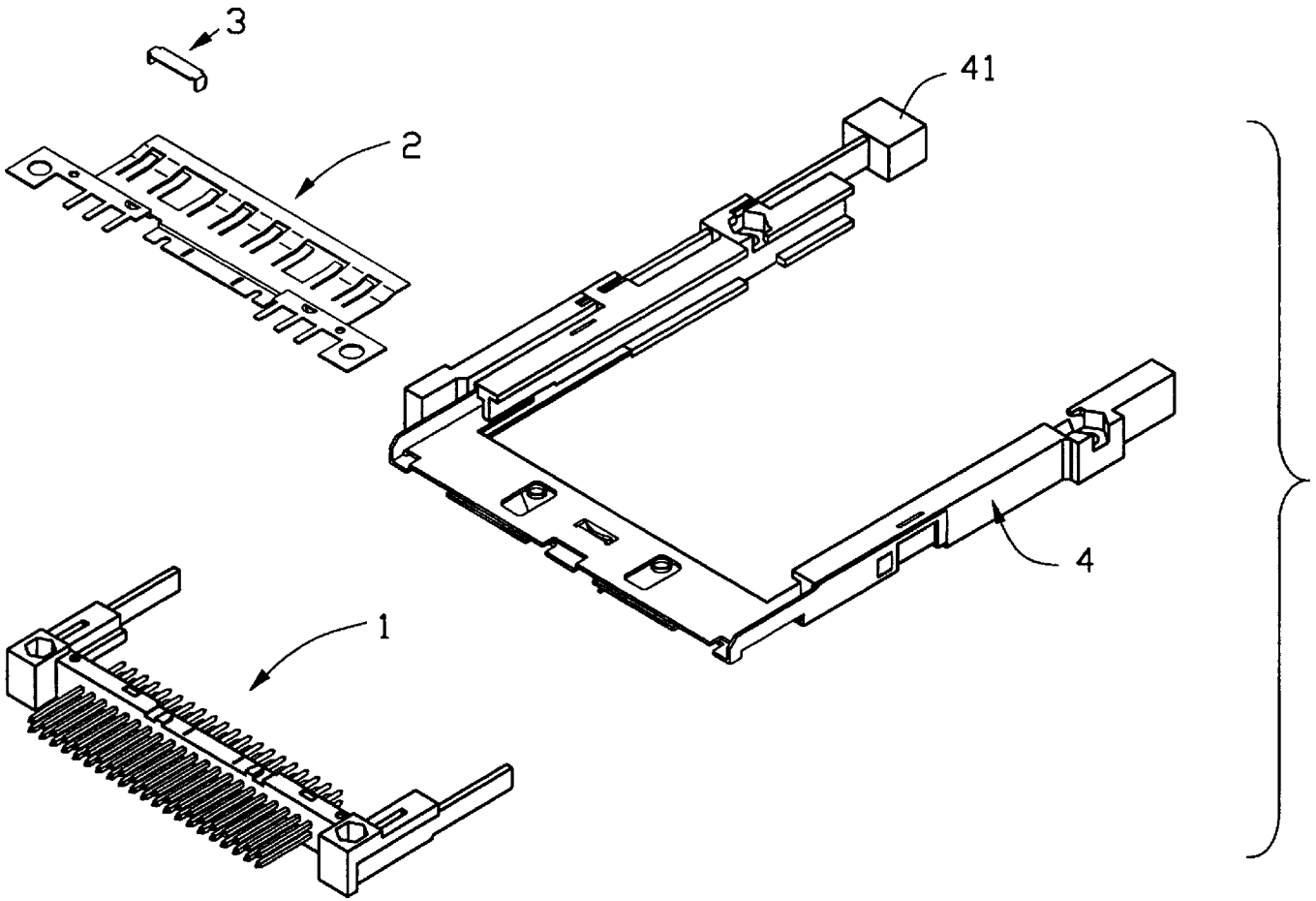
FIG. 2 is an exploded view of an electrical card connector embodying the concepts of the present invention.

FIG. 2 shows an electrical card connector of the present invention comprising a header 1, a grounding shield 2, a fastener 3 and a casing 4 for receiving an electrical card (not shown) and having a card ejecting mechanism 41.

Figure 3:
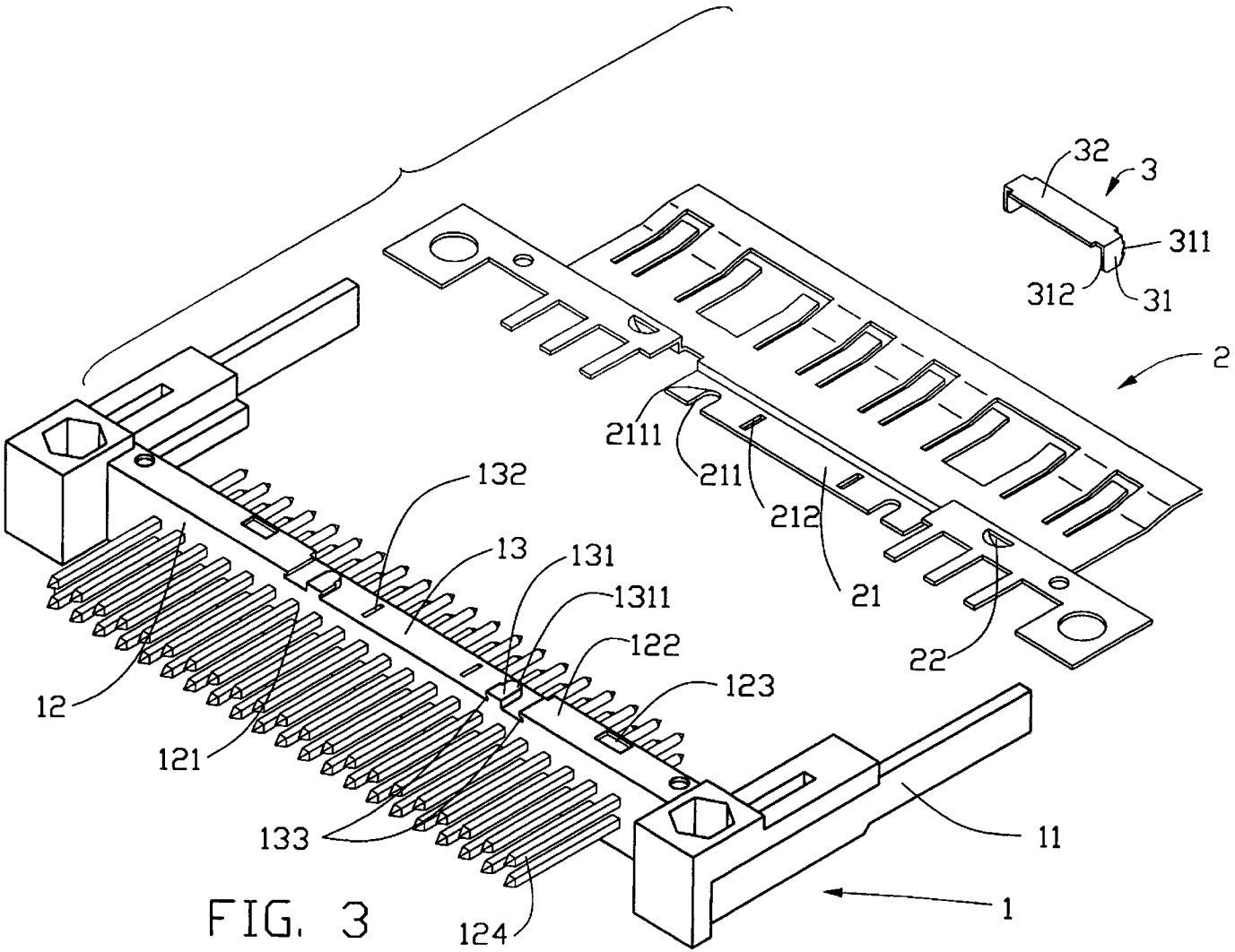
FIG. 3 is an enlarged view of FIG. 2 without a casing being shown.

Referring to FIG. 3, the header 1 includes two arms 11 parallel to each other and a body 12 connecting the two arms 11. The body 12 defines a plurality of passageways 121 each receiving a terminal 124 therein. A top face 122 of the body 12 has a recessed surface 13 along a middle portion thereof. A pair of recesses 123 is defined in the top surface 122 proximate opposite ends of the recessed surface 13. Two protrusions 131 are formed on the recessed surface 13 proximate opposite ends thereof. Each protrusion 131 forms an arcuate outer surface 1311 thereon. Two insertion slots 132 are defined in the recessed surface 13 between the two protrusions 131. Grooves 133 are defined in opposite ends of the recessed surface 13 and inner sides of the protrusions 131 for receiving the grounding shield 2 therein.

The grounding shield 2 forms an attaching portion 21 and tabs 22 corresponding to the recessed surface 13 and the recesses 123 of the header 1, respectively. The attaching portion 21 defines two cutouts 211 each having an arcuate inner surface 2111, and two fixing slots 212 corresponding to the protrusions 131 and the insertion slots 132 of the header 1, respectively.

The fastener 3 is U-shaped and includes a planar connecting portion 32 and two inserting portions 31 extending from opposite sides thereof. Each inserting portion 3 1 forms a tined edge 311 and an opposite flat edge 312. The tined edges 311 of the two inserting portions 31 are on the same side of the fastener 3.

Figure 4:
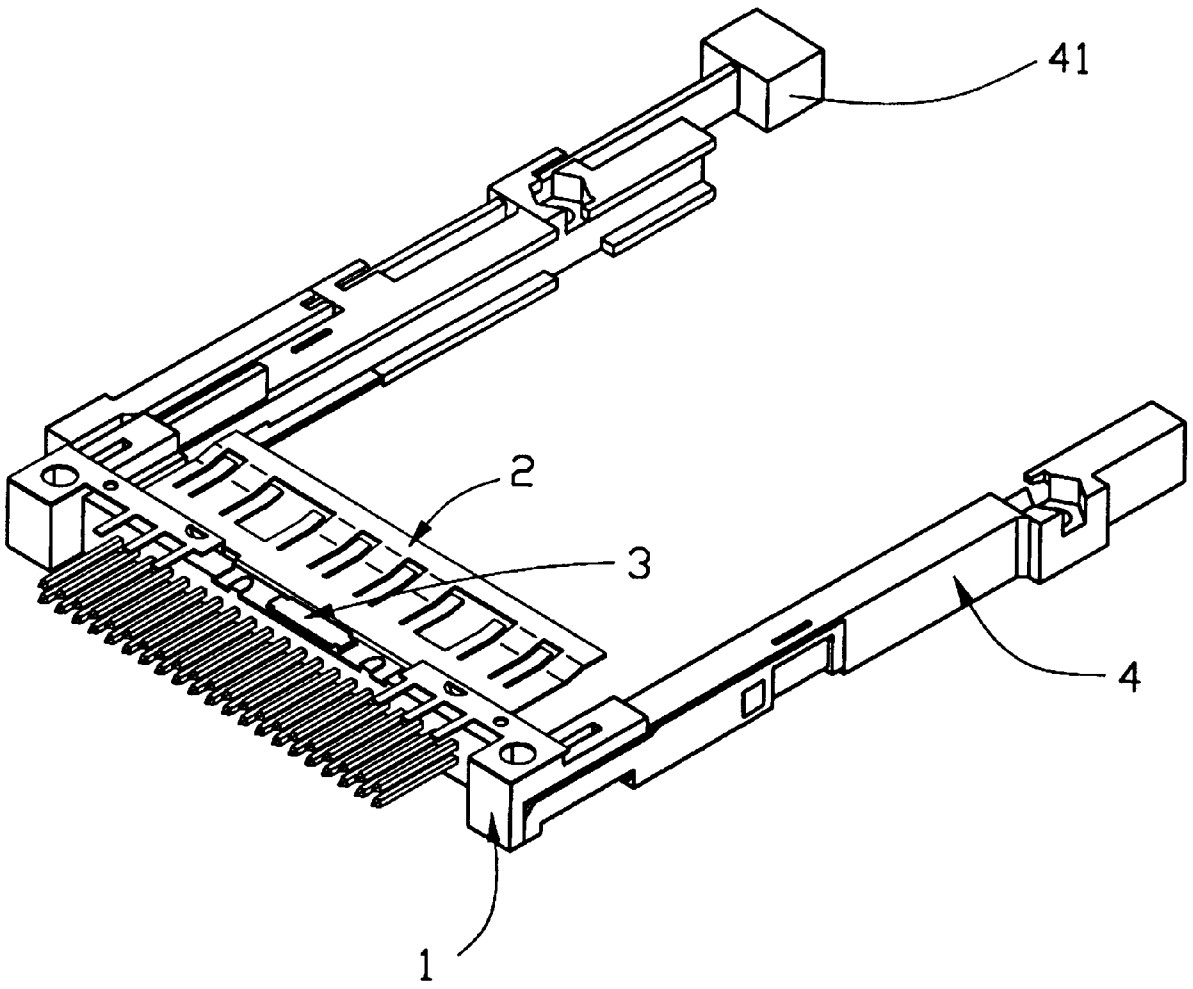
FIG. 4 is an assembled view of FIG. 2.
Figure 5:
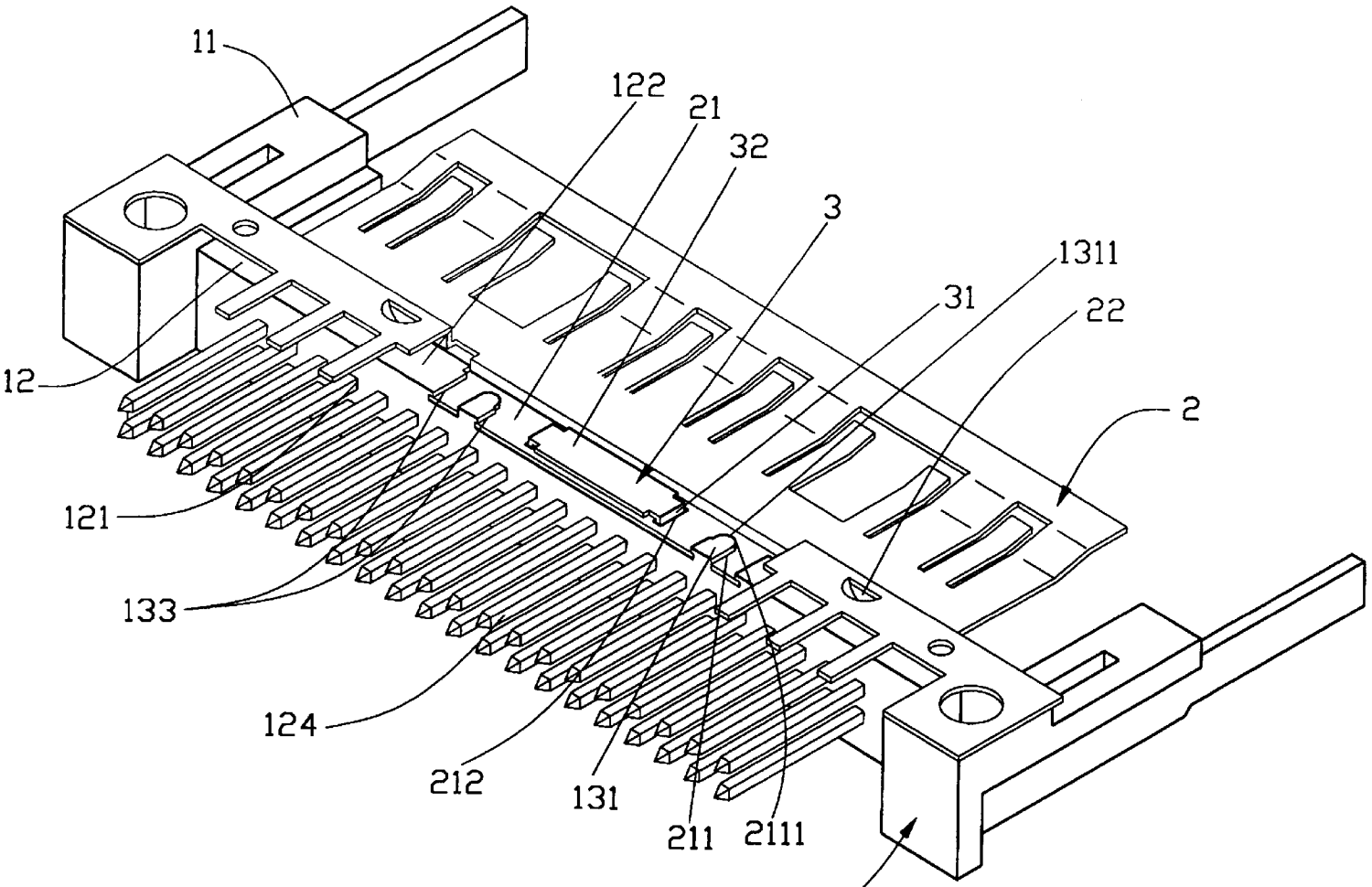
FIG. 5 is an assembled view of FIG. 3.

Referring to FIGS. 4 and 5, in assembly, the attaching portion 21 of the grounding shield 2 is received in the grooves 133 of the header 1, the cutouts 211 of the shield 2 engage with the corresponding protrusions 131 of the header 1, and the tabs 22 of the shield 2 are received in the corresponding recesses 123 of the header 1. The inserting portions 3 1 of the fastener 3 extend through the corresponding fixing slots 212 of the grounding shield 2 and are received in the insertion slots 132 of the header 1. The tined edge 3 11 of each inserting portion 3 1 extends toward the casing 4 and is interferentially engaged with the header 1. Thus, as far as the header 1 concerned, the grounding shield 2 cannot move due to the restriction provided by the protrusions 13 1 of the header 1 and the flat edge 312 of the fastener 3. Furthermore, the grooves 133 of the header 1 and the connecting portion 32 of the fastener 3 also restrict the grounding shield 2 to move relatively to the header 1.

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. An electrical card connector comprising:

a header having a recessed surface at a top face thereof, a plurality of insertion slots being defined in the header from the recessed surface, a plurality of protrusions extending from the recessed surface;

a grounding shield attached to the top surface of the header along a given direction, the grounding shield having an attaching portion which is mounted on the recessed surface and defines a plurality of cutouts facing toward the given direction and a plurality of fixing slots therein, the cutout engaging with the protrusions of the header to restrict the shield from moving toward the given direction; and a fastener having a pair of inserting portions, each inserting portion forming a flat edge at a side thereof facing the given direction and a tined edge opposite the flat edge for extending through the fixing slot of the shield and into the insertion slot of the header to restrict the shield from moving toward a direction opposite to the given direction.

2. The electrical card connector as described in claim 1, wherein each protrusion has an arcuate outer surface and each cutout has an arcuate inner surface for engaging with the arcuate outer surface of the protrusion.

3. The electrical card connector as described in claim 1, wherein each protrusion defines a groove in a side thereof.

4. The electrical card connector as described in claim 1, wherein said recessed surface defines grooves in opposite ends thereof.

5. The electrical card connector as described in claim 1, wherein said top surface defines a pair of recesses proximate opposite ends of the recessed surface.

6. The electrical card connector as described in claim 4, wherein said grounding shield forms a pair of tabs corresponding to the recesses of the header.

7. The electrical card connector as described in claim 1, wherein said fastener has a connecting portion connected between the two inserting portions.

8. The electrical card connector as described in claim 7, wherein said tined edges of the inserting portions are formed on the same side of the fastener.

9. An electrical card connector comprising:

a header having a top surface forming a pair of insertion slots therein;

a grounding shield attached to the top surface of the header, a pair of fixing slots formed within the grounding shield and in alignment with said pair of insertion slots, respectively; and a fastener including a pair of inserting portions vertically extending from two opposite ends of an elongated connecting portion wherein said pair of inserting portions extend through the corresponding pair of fixing slots and further into the corresponding pair of insertion slots, respectively, in an interferential manner and wherein said connecting portion extends along a lengthwise direction of the header.

* * * * *